United States Patent [19]

Hinckle

[11] Patent Number: 4,846,087

[45] Date of Patent: Jul. 11, 1989

[54] METHOD AND APPARATUS FOR CLAMPING AND MANIPULATING WORKPIECES DURING A SEWING OPERATION

[75] Inventor: John E. Hinckle, Richmond, Va.

[73] Assignee: Apparel Machinery International, Ltd., Richmond, Va.

[21] Appl. No.: 227,233

[22] Filed: Aug. 1, 1988

Related U.S. Application Data

[62] Division of Ser. No. 55,135, May 28, 1987, Pat. No. 4,799,438.

[51] Int. Cl.[4] ..... D05B 97/00; D05B 21/00

[52] U.S. Cl. ..... 112/262.3; 112/265.2

[58] Field of Search ..... 112/262.3, 265.2, 121.12, 112/121.11, 121.15, 121.14, 104, 318, 322

[56] References Cited

U.S. PATENT DOCUMENTS

| | | | |
|---|---|---|---|
| 882,480 | 3/1908 | Rontke | 112/121.12 X |
| 2,894,469 | 7/1959 | Van Amburg et al. | 112/136 |
| 3,750,604 | 8/1973 | Carrel et al. | 112/265.2 |
| 3,752,097 | 8/1973 | Fuller, Jr. et al. | 112/121.12 |
| 3,765,349 | 10/1973 | Gerber | 112/121.12 X |
| 4,434,731 | 3/1984 | Beisler | 112/318 |
| 4,467,736 | 8/1984 | Perlino | 112/121.14 |
| 4,592,295 | 6/1986 | Cordier | 112/121.12 X |
| 4,601,249 | 7/1986 | Frye | 112/104 X |
| 4,736,695 | 4/1988 | Junemann | 112/121.14 X |

*Primary Examiner*—H. Hampton Hunter

*Attorney, Agent, or Firm*—Bacon & Thomas

[57] ABSTRACT

The present invention relates to a method and apparatus for clamping and manipulating clothing components with respect to a double needle sewing machine so as to automatically attach and finish stitch a left fly to a front panel of a jeans style garment. The apparatus includes a work holding carriage which translates along a path generally perpendicular to a plane containing dual sewing machine needles. A pair of rotatable discs which are mounted on the carriage in nested fashion and rotate about spaced apart centers of rotation. The axes for the centers of rotation extend substantially perpendicular to the carriage and generally parallel to the dual sewing machine needles. The invention not only encompasses a method for carrying out the sewing operations, but also an apparatus including a drive mechanism for the trasversing carriage, a rotating mechanism for each of the nested rotating discs and a clamping apparatus for holding and positioning the aseembled fly with respect to the jeans panel.

12 Claims, 9 Drawing Sheets

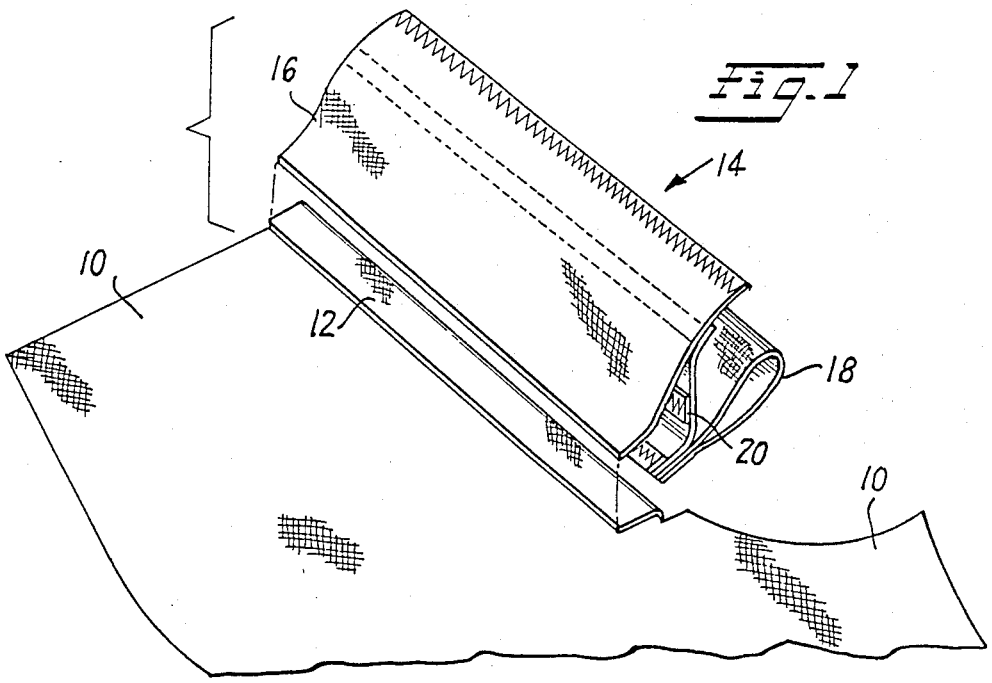
Fig. 1
Fig. 2
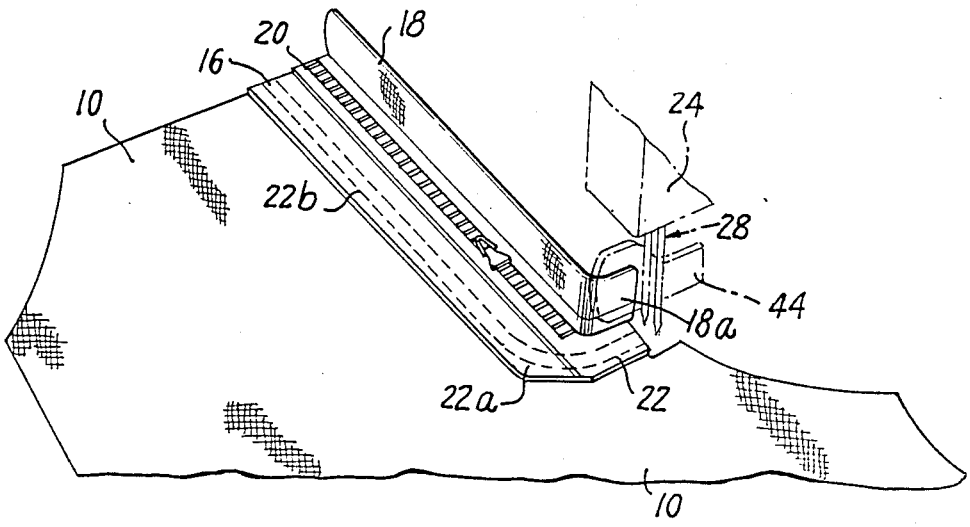

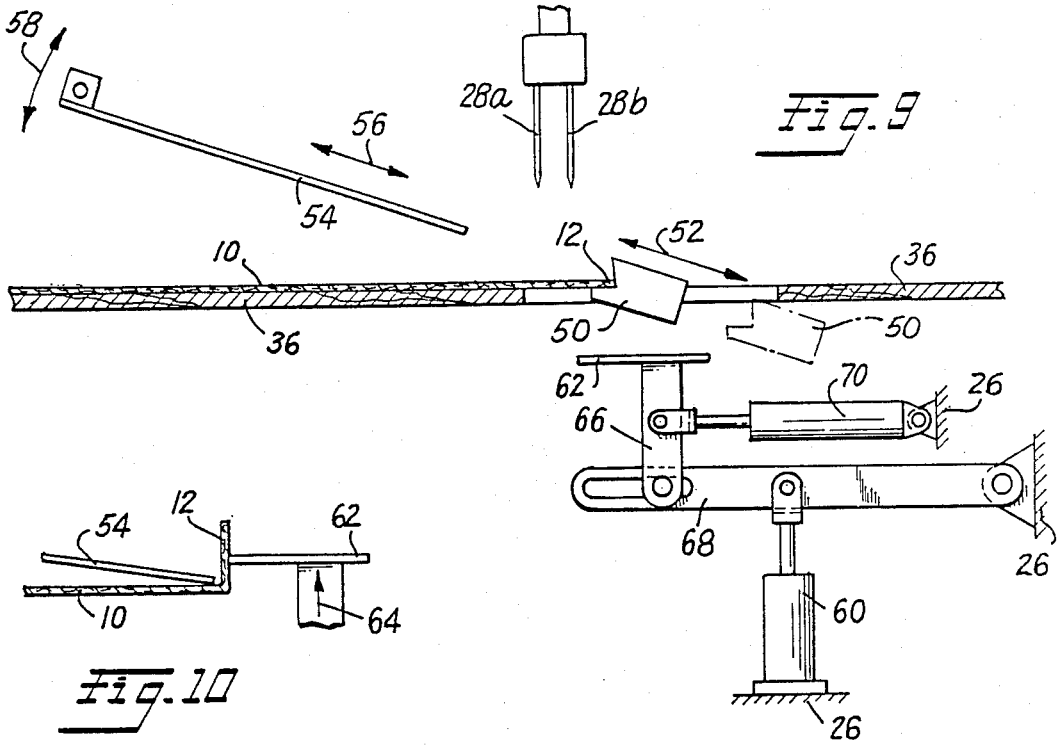
Fig. 9
Fig. 10
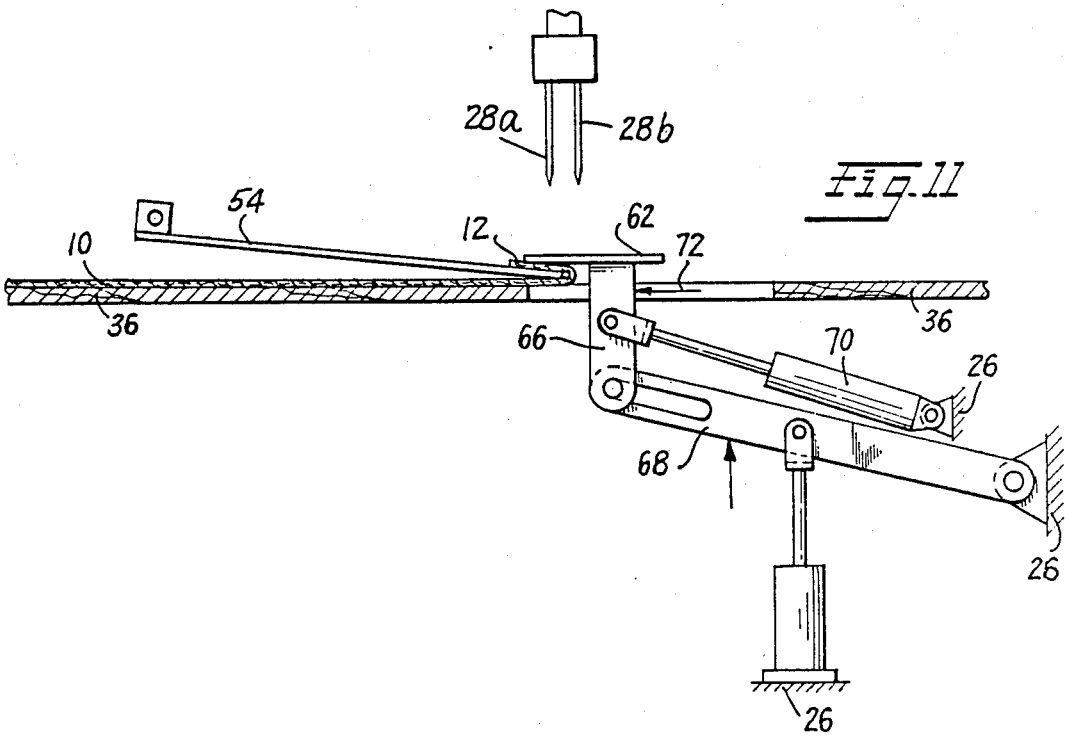
Fig. 11

26
136
132
134
122
160
188
174
172
168
166
164
158
162
146
148
154
184
190
130
126
156
152
150
128
138
140
170
124
178
180
182
176
A
B
22

METHOD AND APPARATUS FOR CLAMPING AND MANIPULATING WORKPIECES DURING A SEWING OPERATION

This application is a division, of application Ser. No. 055,135, filed May 28, 1987, now U.S. Pat. No. 4,799,438, issued Jan. 24,1989.

FIELD OF THE INVENTION

This invention relates to a sewing machine structure, more particularly an apparatus for automatically sewing a 'J' stitch to attach a fly assembly to a panel of jeans style pants.

BACKGROUND OF THE INVENTION

In the manufacture of jeans style pants, the operations of attaching and finishing the left fly are very difficult sewing operations and ones that have a large influence on the appearance quality of the finished garment. The quality aspects is of particular importance on the finishing operation which involves sewing the outline of a "J" which is readily visible on the front of the garment. It is important that the curved part of the "J" be a uniform radius and that the stem of the "J" be parallel to the edge of the fly.

With the typical manual method of sewing using a sewing machine, the operator must guess at the radius of the curve and estimate where the edge of the fly is in order for the stem of the "J" to come out parallel. This is made all the more difficult in that while the operator is carrying out these operations, the garment is face down on the sewing machine bed such that the operator cannot see the appearance of the final product.

In all of the various sizes, types and styles of jeans, the only variable in the size of the fly is the length. The width of all flys are the same and the curved portion of the "J" is always a constant, as is the relation between the bottom of the fly assembly to the "J".

Although numerous sewing machines, supporting beds and clamping devices are known for assembling fly flap portions of a garment, and inserting and sewing a fly into the garment, no devices are known which are capable of consistently and accurately sewing the "J" stitch pattern to attach and finish the left fly to a jeans style garment.

SUMMARY OF THE INVENTION

The present invention relates to a work clamping and manipulating bed associated with a sewing machine which will automatically attach and finish stitch a left fly to a front panel of a jeans style garment. The apparatus comprises a work holding table which translates along a path generally perpendicular to a reciprocating plane containing single or dual sewing machine needles. The table has mounted thereon a pair of rotatable discs which are mounted in nested fashion and which rotate about spaced apart centers of rotation. The axes for the centers of rotation extend substantially perpendicular to the carriage and generally parallel to the dual sewing machine needles.

A first clamping device serves to clamp a left front jeans panel to the innermost disc, while a second clamping system grips the assembled fly, which consists of the left fly, the right fly and the zipper tape which interconnects these elements. The second clamping device holds the assembled fly against the jeans panel such that the left fly is brought into contact therewith. The carriage then traverses with respect to the sewing machine such that the single needle or one of the dual needles stitches the left fly to the jeans panel.

The traversing carriage is then repositioned such that the center of rotation of the inner disc is approximately coincident with the needle center line. The second clamping device is moved such that the left fly piece comes into contact with the jeans panel and the innermost disc rotates approximately 90° in a counterclockwise direction. The traversing carriage continues in its original direction of movement for approximately four stitches, after which the carriage stops while the outermost disc rotates about its axis of rotation such that both discs rotate approximately 90° in a counterclockwise direction when viewed from the top of the carriage. During this rotation, the sewing machine continues to operate so as to form the curved portion of the "J" stitch. After completing the curved portion of the stitch, the carriage continues its traversing movement to complete the stem of the "J" stitch.

The invention not only encompasses a method for carrying out the sewing operations noted above, but also an apparatus therefore, including a drive mechanism for the traversing carriage, a rotating mechanism for each of the nested rotating discs and a clamping apparatus for holding and positioning the assembled fly with respect to the jeans panel.

DETAILED DESCRIPTION OF THE DRAWINGS

FIG. 1 is an exploded fragmentary perspective view showing a jeans panel and an assembled fly.

FIG. 2 is a fragmentary perspective view showing the "J" stitch attaching the assembled fly to the jeans panel.

FIGS. 9, 10 and 11 are diagrammatic elevational views showing a mechanism for folding the edge of the jeans panel prior to attaching the assembled fly.

DETAILED DESCRIPTION OF THE PREFERRED EMBODIMENT

Figure 3:
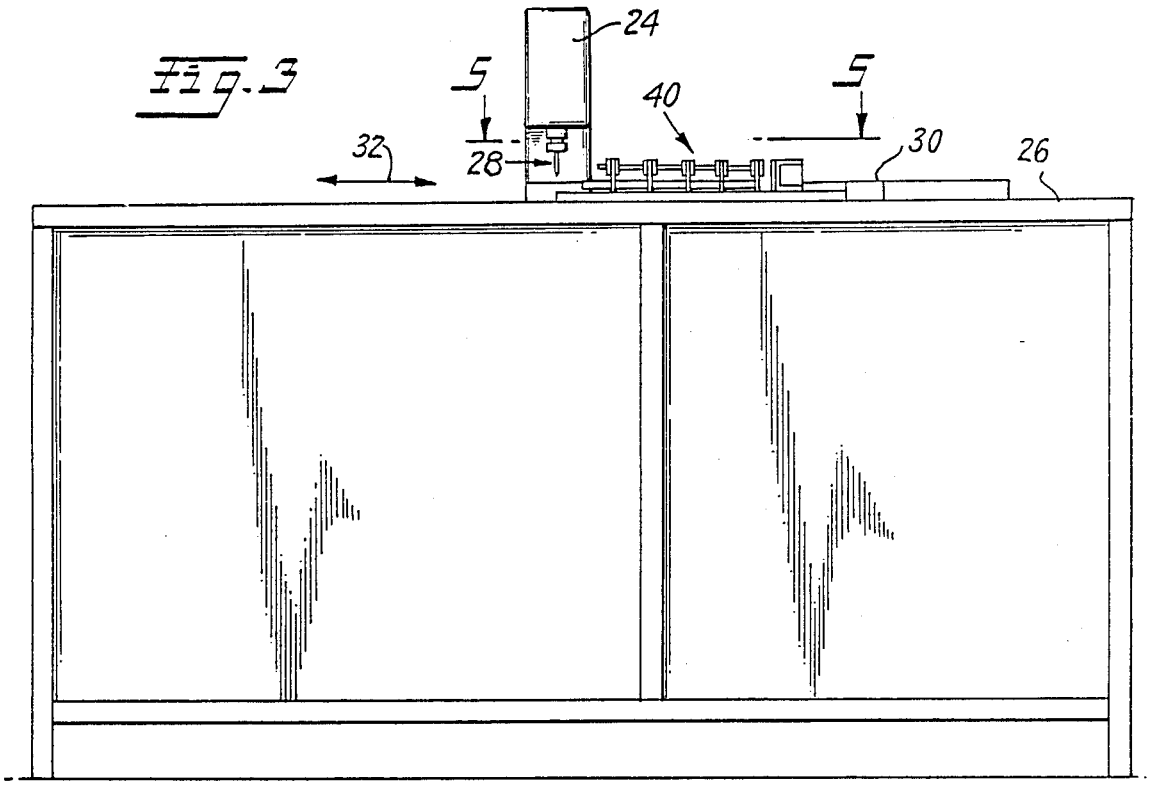
FIG. 3 is a front elevational view of the "J" stitch sewing apparatus according to the invention.
Figure 4:
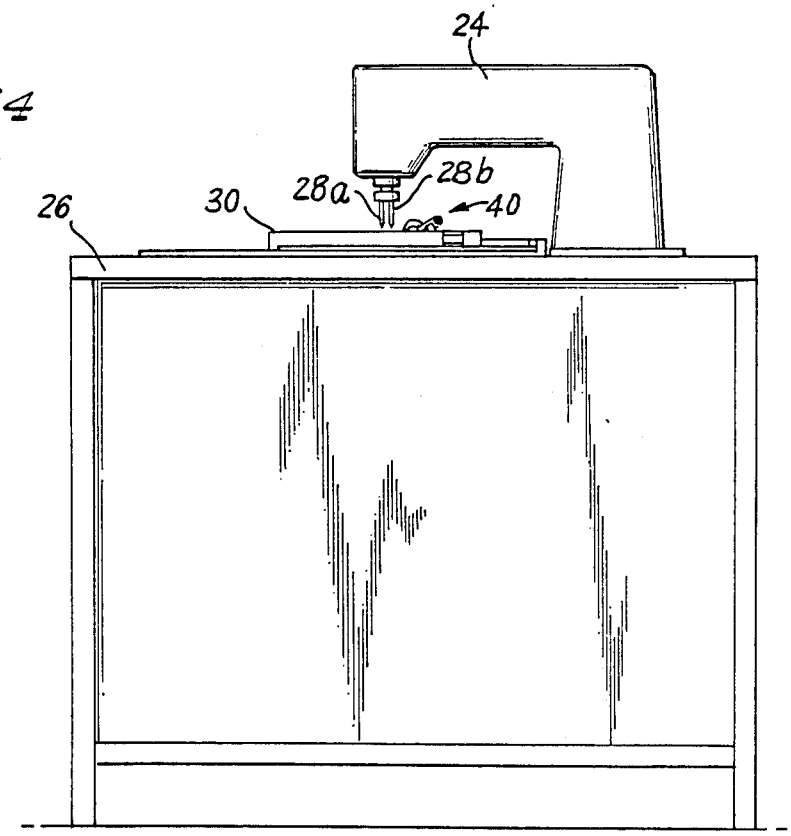
FIG. 4 is an end elevational view of the sewing machine assembly sown in FIG. 3.

The present invention relates to a method and apparatus for automatically attaching an assembled fly to the left panel of a jeans type garment. The attachment is achieved by a "J" stitch which is readily visible on the front of the garment. Since the stitch is readily visible, it is of utmost importance that the curved part of the "J" stitch be of uniform radius and that the stem of the "J" be parallel to the edge of the fly. On all of the various jeans garments, the only variable in the size of the fly is the length. The width of all the flys are the same and the curved portion of the "J" is a constant as is the relation of the bottom of the assembled fly to the "J" stitch. Thus, the present invention will provide a consistency uniform, high quality "J" stitch on virtually all type of jeans garments.

As shown in FIG. 1, jeans panel 10 has folded edge portion 12. The apparatus for folding this edge portion back onto the jeans panel will be more fully described hereinafter. The assembled fly 14 comprises left fly 16, right fly 18 and zipper tape 20 which interconnects the left and right pieces. The assembled fly is interconnected to the jeans panel 10 by a "J" stitch 22, illustrated in FIG. 2, formed by a dual needle sewing machine. In order to improve the quality of the garment it is imperative that the curved portion 22*a* of the "J" stitch be of uniform radius and that the stem portion 22*b* be parallel to the edge of folded portion 12.

The apparatus according to the invention is utilized with a sewing machine 24 rigidly mounted on table structure 26. The sewing machine, per se, forms no part of the instant invention and any known sewing machine having a single needle or dual needles 28*a* and 28*b* may be utilized in accordance with this invention. Carriage 30 is slidably attached to the upper surface of table structure 26 so as to translate in the direction of double arrow 32 in FIG. 3, generally perpendicular to the plane of the sewing needles 28*a* and 28*b*.

Figure 5:
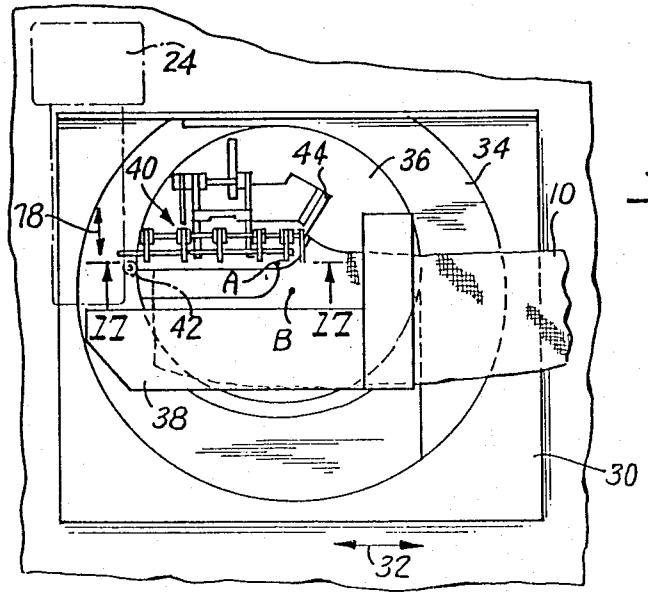

Outer disc 34 and inner disc 36 are mounted flush with the upper surface of carriage 30 in nested fashion such that the upper surfaces of the carriage 30, the outer disc 34 and the inner disc 36 present a substantially flat surface. The inner and outer discs are mounted so as to be rotatable relative to each other and relative to the carriage 30. The inner disc 36 rotates about axis A, while outer disc 34 rotates about axis B which is laterally displaced from axis A, as shown in FIG. 5. The distance between axes A and B is approximately equal to the radius of the curvature of the curved portion 22*a* of the "J" stitch 22.

Before giving a detailed description of the fly clamping and positioning device, and the drive mechanism for the carriage and the nested, rotatable discs, a brief overview of the operational steps of the invention will be described referring to FIGS. 5–16. The beginning position is shown in FIG. 5 with the carriage 30 displaced generally to the right of the sewing machine head 24. The operator places the jeans panel 10 on the support surface defined by the inner disc 36, the outer disc 34 and the carriage 30 such that the outer facing surface of the jeans panel is faced downwardly on this surface. A clamping device 38, pivotally supported on inner disc 36 is moved downwardly into contact with the jeans panel to fixedly hold it in place. The movement of the clamping device 38 may be achieved either manually or by any known automatic control means. The clamping device 38 generally comprises a flat surface to provide a broad contact area between the jeans panel 10 and the clamping device.

Figure 6:
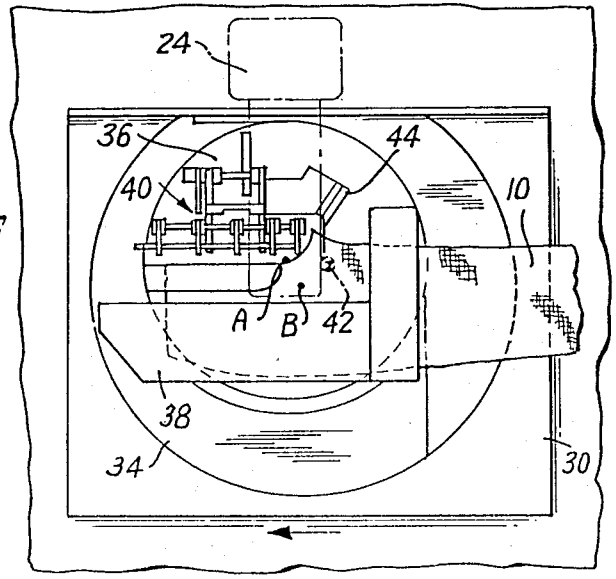
Figure 12:
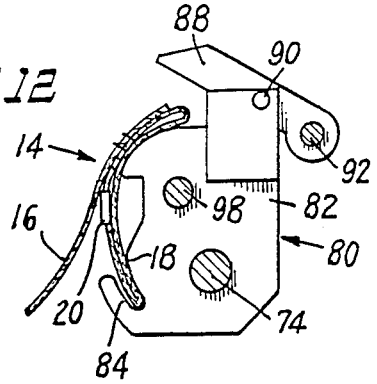
FIGS. 12–16 are diagrammatic views showing the clamping device for clamping and positioning the assembled fly with respect to the jeans panel.
Figure 15:
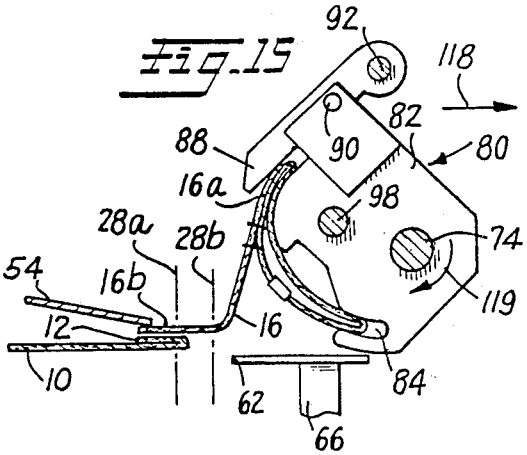
Figure 16:
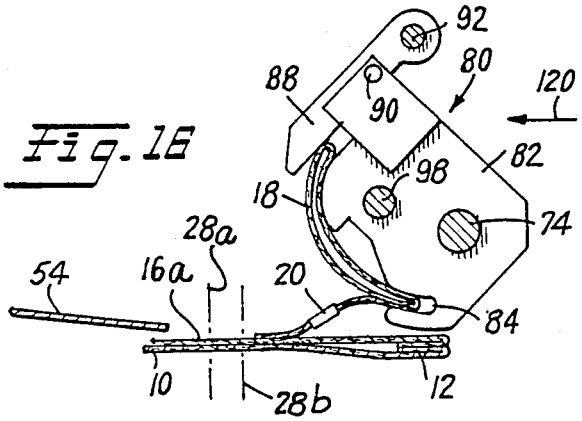

A second clamping device, fly clamping assembly 40, also fixedly mounted on the inner disc 36 holds the assembled fly in a plurality of positions relative to the jeans panel 10. The edge portion 12 of the panel 10 is folded over onto the jean panel, as shown in FIG. 1 and the fly clamp assembly 40 is rotated so as to bring the left fly 16 into contact with the folded edge portion 12. Once the machine cycle has been activated, the carriage 30 undergoes a rapid transit mode to the left, as seen in FIG. 5, until the end of the jeans panel 10 is sensed by photocell 42. Once the end of the jeans panel 10 is sensed by the photocell, the sewing machine 24 is started and the carriage speed slows to match the sewing machine speed in order to produce the desired number of stitches per inch. As the carriage 30 progresses to the left, as shown in FIGS. 5 and 6, the needle 28*a* passes through the left fly 16, the folded edge 12 and the jeans panel 10, as shown in FIG. 15 to attach these elements together. The sewing needle 28*b* passes only through the left fly 16.

Since the bottom portion of the fly is constant for all sizes of jeans, the machine is programmed to stop at the same point regardless of the size of jeans being manufactured. The sewing machine is programmed to stop approximately one stitch beyond the bottom of the fly while the carriage continues to move to the left, as seen in FIG. 6, until the bottom of the fly is approximately $\frac{3}{8}$ of an inch beyond the sewing needles 28.

The fly clamp assembly 40 is rotated slightly in a clockwise direction while at the same time translating in a direction away from the jeans panel 10 such that an upper portion of the left fly is unclamped and lays flat on top of the jeans panel 10. An end fold mechanism, shown generally at 44, folds the bottom portion 18a of the right fly at an approximately 90° angle to the remainder of the fly, as shown in FIG. 2, out of the way of the sewing needles 28.

Figure 7:
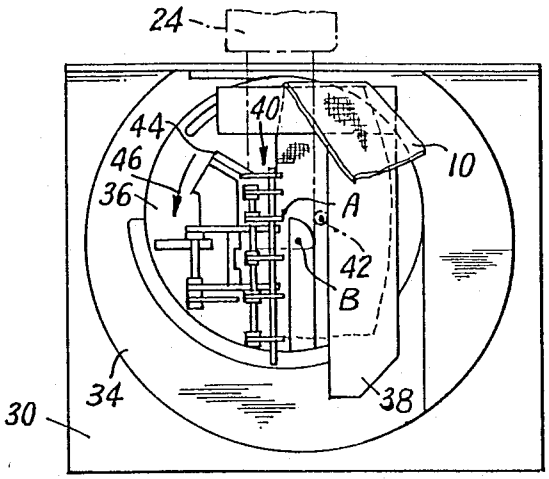
FIGS. 5, 6, 7 and 8 are diagrammatic plan views showing various positions of the inner and outer rotating nested discs on the traversing carriage according to the invention.

The carriage 30 then moves approximately $\frac{3}{4}$ inch to the right, as viewed in FIGS. 5–8, and stops while the inner circle 36 rotates approximately 90° counterclockwise in the direction of arrow 46, shown in FIG. 7. Once this is achieved, the sewing machine once again starts and the carriage 30 moves to the left, as seen in FIG. 7, a distance of approximately four stitches after which the carriage stops. The outer disc 34 then rotates about its axis of rotation B approximately 90° in a counterclockwise direction as indicated by arrow 48 in Figure 8 carrying the inner circle 36 and the clamped jeans panel with it. Sewing machine 24 continues operation during the rotation of outer disc 34 so as to sew the curved portion 22*a* of the "J" stitch.

Figure 8:
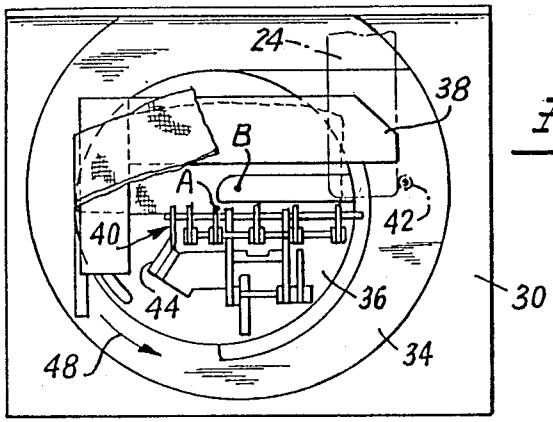

Upon completion of the 90° of rotation, the outer disc rotation stops and the carriage 30 continues its movement to the left, as shown in FIG. 8, while the sewing machine is operating to complete the stem portion 22*b* of the "J" stitch. A known photocell system may be utilized to stop the sewing machine when the top of the jeans panel has been reached and activate a thread trimmer in known fashion. The clamping plate 38 is then elevated and the jeans panel with the fly attached thereto is removed. The carriage and discs are then recycled to their initial positions shown in FIG. 5.

The method and apparatus for positioning the jeans panel 10 with respect to the sewing needles 28*a* and 28*b* as well as folding over the edge portion 12 are illustrated in FIGS. 9–11. As shown in FIG. 9, the jeans panel 10 is placed over the inner and outer discs 36 and 34, and the carriage 30 such that the edge of the fly opening 12 bears against a movable stop 50. Movable stop 50 serves to accurately position the jeans panel 10 with respect to the sewing needles 28*a* and 28*b*. The stop is movable in the direction of arrow 52 between an extended position, shown in solid lines in FIG. 9, and a retracted position, shown in dashed lines in FIgure 9. Stop 50 may be mounted on a pneumatic or hydraulic actuating device (not shown) attached to the table structure 26 by any known means which will serve to move it between its extended and retracted positions. The precise structure for mounting the movable stop, per se, forms not part of the instant invention.

Once the jeans panel 10 has been positioned by the operator, it is held in position, by clamping device 38 as previously described. A hold down plate 52, generally planar in configuration, is attached to the device so as to be capable of translational movement, as illustrated by arrows 56 and also arcuate movement, as illustrated by arrows 58. Hold down plate 54 may comprise a generally planar structure having a length substantially equal to the length of the assembled fly. Once the jeans panel has been positioned and clamped into place, hold down plate 54 moves downwardly and to the right, as seen in FIG. 9, until the end contacts the jeans panel 10, as illustrated in FIG. 10. At this point, the movable stop 50 is moved to its retracted position below the surface of the carriage and the nested discs, and cylinder 60 is activated so as to move elevator plate 62 upwardly in the direction of arrow 64 in FIG. 10. Elevator plate 62 is interconnected to cylinder 60 via links 66 and 68, one end of link 68 being pivotally interconnected with table structure 26. Similarly, cylinder 60 may also be mounted to the table structure 26. As can be readily seen from FIGS. 9 and 11, extension of the piston rod of cylinder 60 causes link 68 to pivot about its attachment point and thereby move elevator plate 62 in an upward direction.

Contact between the elevator plate 62 and edge portion 12 causes this edge portion to fold upwardly while the hold down plate 54 maintains the remainder of the jean panel against the support surface. Once the edge portion 12 has been folded to a generally vertical position, as seen in FIG. 10, cylinder 70 is actuated to extend its piston rod, thereby causing the elevator plate 62 to move in the direction of arrow 72, as shown in FIG. 11, to fold end portion 12 over onto the upper surface of hold-down plate 54. Hold-down plate 54 is then withdrawn to the left, as viewed in FIG. 11, such that edge portion 12 lies on top of jeans panel 10 and is retained in position by the lower surface of elevator plate 62.

While the edge 12 of the jeans panel 10 is being folded as described, the machine operator loads the assembled fly into the fly clamping and positioning device 40. As illustrated in FIGS. 12–20, this device comprises a main shaft 74 attached to inner disc 36 via control arms 76. Control arms 76 are connected to a pneumatic or a hydraulic cylinder or the like (not shown) so as to move the main shaft 74 in the direction of arrows 78 in FIG. 5.

A plurality of toggle clamp devices 80 are mounted on main shaft 74. Each of the toggle clamps 80 comprises a locating member 82 defining a lower locating slot 84 and an upper locating surface 86. A clamping jaw member 88 is pivotally attached to locating member 82 so as to pivot about axis 90. A rod 92, extending generally parallel to main shaft 74, interconnects all of the jaw members 88. One or more of the clamping devices 80 has a compression spring 94 interposed between the locating member 82 and the clamping jaw member 88. The attachment between the compression spring 94 and the clamping jaw 88 is such that the force exerted on the clamping jaw 88 by the compression spring is on one side of the axis 90 such that the force tends to maintain the clamping jaw in the open position shown in FIG. 18. As shown in that Figure, the force exerted on the clamping jaw member 88 is to the left of the center line of the pivot axis 90. When the clamping jaw member 88 is manually rotated in a counterclockwise direction, as viewed in Figure 18, the upper portion of the compression spring 94 is displaced to the right side of the axis 90 such that the force exerted on the clamping member by the spring tends to hold the clamping jaw member in a closed or clamped position. Thus, the mechanism comprises an over-center toggle mechanism which will maintain the clamping jaw member in either the opened or the closed position. The clamping jaw members 88 may be manually rotated about axis 90 via a lever 96 which pivots about axis 90 and is connected to shaft 92 such that all of the jaw members are pivoted simultaneously.

Figure 17:
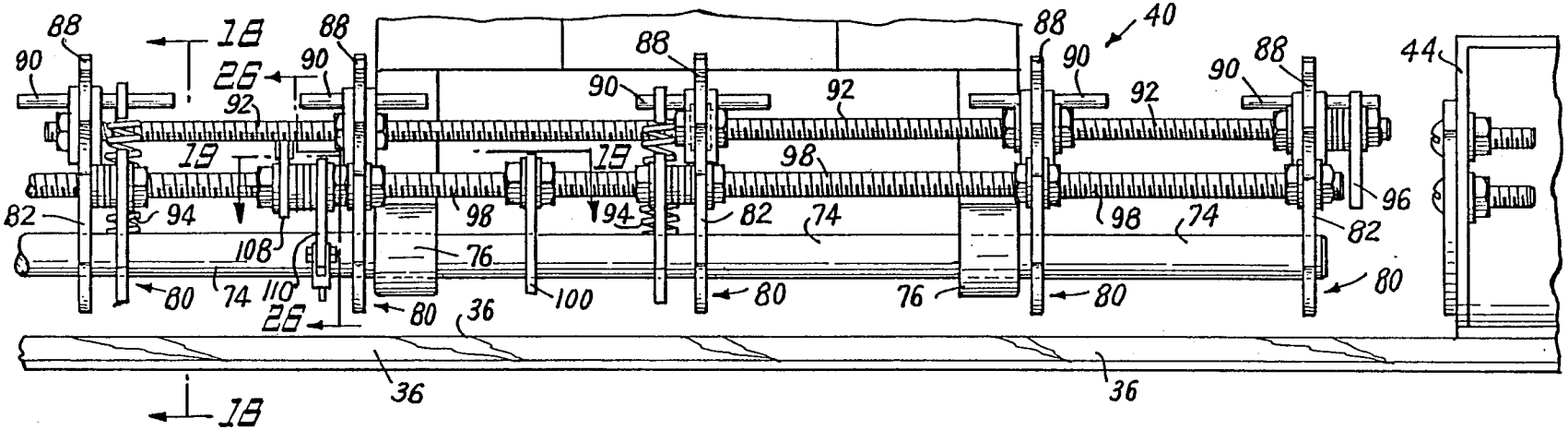
FIG. 17 is a fragmentary elevational view of the assembled fly clamping device taken along line 17—17 of FIG. 5.

As shown in FIG. 17, the toggle compression spring 94 is utilized on two of the five toggle clamping devices. The precise number of toggle clamps which utilize the spring 94 is not critical to the invention, and more or less than two such devices may be utilized without exceeding the scope of this invention.

Figure 20:
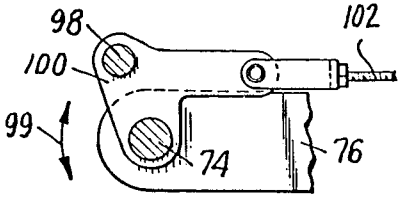
FIG. 20 is a fragmentary, sectional view taken along line 20—20 of FIG. 19.
Figure 19:
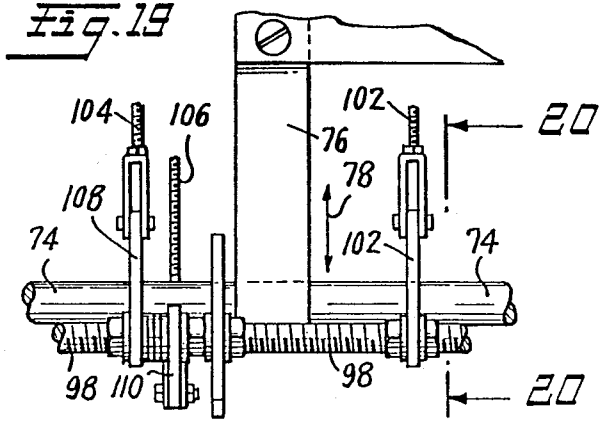
FIG. 19 is a fragmentary horizontal sectional view taken along line 19—9 of FIG. 17.
Figure 18:
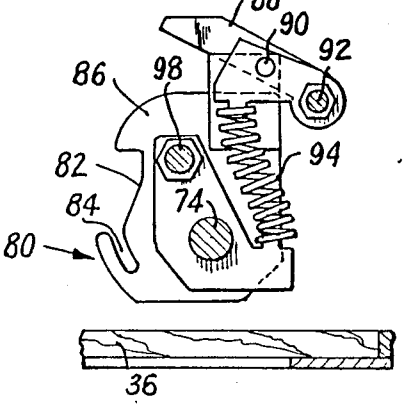
FIG. 18 is a fragmentary sectional view of the clamping device taken along line 18—18 of FIG. 17.

Pivot actuating shaft 98 interconnects all of the locating members 82 and extends generally parallel to main shaft 74. As noted in FIG. 18, the axis of pivot shaft 98 is displaced from that of main shaft 74. Bell crank 100 is affixed to shaft 98 and is pivotally attached to main shaft 74. Pivot link 102 connects bell crank 100 with a piston rod of a linear actuator (not shown) such as a pneumatic or hydraulic cylinder. The linear actuator is attached to the inner disk 36 so as to move with the control arms 76. Extension or contraction of the piston rod of the linear actuator cylinder causes bell crank 100 to pivot about main shaft 74 in the direction of arrow 99 which, due to the interconnection with shaft 98, also causes all of the toggle clamp members 80 to pivot about main shaft 74 in the same direction. The position of bell crank 100 in FIG. 20 corresponds with the orientation of the toggle clamp 80 shown in FIG. 18. As connecting link 102 is moved toward the left, as seen in FIG. 20, bell crank 100 pivots in a counterclockwise direction about main shaft 74 causing the toggle clamps to assume the position in FIG. 14.

Shaft 98 also has a pair of drag links 104 and 106 attached thereto via drag link bell cranks 108 and 110, respectively. Drag links 104 and 106 are slidably and pivotally connected to shaft 112 which is stationarily mounted on inner disc 36. Drag links 104 and 106 define slots 114 and 116 such that the translational motion of shaft 74 in the direction of arrows 78 cause the toggle clamp members 80 to pivot slightly as the toggle clamps move in the direction of arrows 78, as well be more fully described in relation to FIGS. 15 and 16.

The end fold mechanism 44 is also shown in FIG. 17 and is movable between an extended position shown in FIG. 5 and a retracted, folding position as shown in FIGS. 2 and 6–8. This extension and retraction may be achieved by pneumatic or hydraulic cylinders or other types of linear actuators (not shown). As shown in FIG. 2, when the end fold mechanism 44 is in its retracted, folding position, it folds the end of the right fly 18a such that it does not interfere with the sewing needles 28 during the sewing of the bottom portion of the "J" stitch 22.

Figure 13:
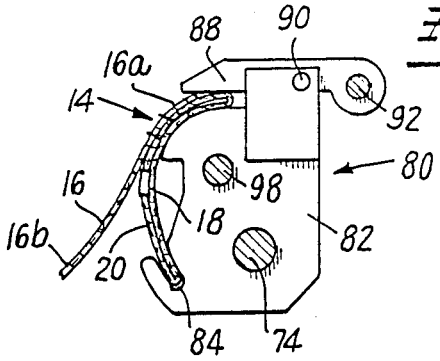

The operation of the toggle clamping devices will now be described in reference to FIGS. 12–16. The assembled fly 14 is placed into the locating members 82 by inserting a lower edge portion of right fly 18 and zipper tape 20 into the guide slot 84 while the upper portion of right fly 18 if brought into contact with guide surface 86. The clamping members 88 are then actuated so as to clamp the upper portion of right fly 18 and a portion 16a of left fly 18 in position as shown in FIG. 13.

Figure 14:
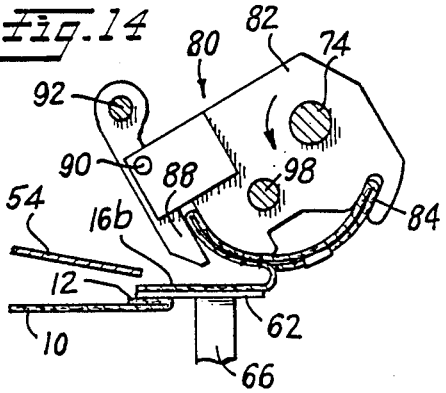

The linear actuator is then activated which causes bell crank 100 to pivot about main shaft 74 in a counterclockwise direction as viewed in FIG. 20. This causes all of the locating members 82 to also pivot in a counterclockwise direction about main shaft 74 to the position shown in FIG. 14. The lower portion **16*b* of left fly 16 is brought against the upper surface of elevator plate 62 which has folded over edge portion 12 onto the jeans panel 10 as previously described. Hold-down plate 54 advances into contact with lower portion 16*b* as the elevator plate 62 is moved toward the right, as seen in FIGS. 14 and 15. This serves to hold the lower end 16*b* in contact with the folded over edge portion 12 as seen in FIG. 15**.

At this point, control arms 76 are retracted slightly so as to move all of the toggle clamps toward the right, as seen in FIG. 15, in the direction of arrow 118. The drag links 104 and 106 cause a slight rotation in the clockwise direction as indicated by arrow 119 during this traversing motion so as to completely move the toggle clamps out of the path of the sewing needles **28*a* and 28*b*. Once the toggle clamps are in this position, the carriage 30 is moved under the sewing machine 24 such that sewing needle 28*a* passes through the left fly 16, the folded over edge portion 12 and the jeans panel 10** so as to attach these elements together.

The toggle clamps are then rotated slightly in a clockwise direction about main shaft 74 while being translated to the left in the direction of arrow 120 such that upper end portion **16*a* slips out from under the clamping member 88. This serves to flip upper end portions 16*a* of the clamping device and onto the top of hold-down plate 54. Plate 54 is then retracted and repositioned on top of the fly portion 16a to hold it in contact with the jeans panel 10. At this point, end fold mechanism 44 is actuated to fold the end 18*a* of the right fly 18 out of the path of the sewing needles as shown in FIG. 2**.

The inner circle 36 is then rotated 90° and the procedure continues as previously described to form the completed "J" stitch.

Figure 21:
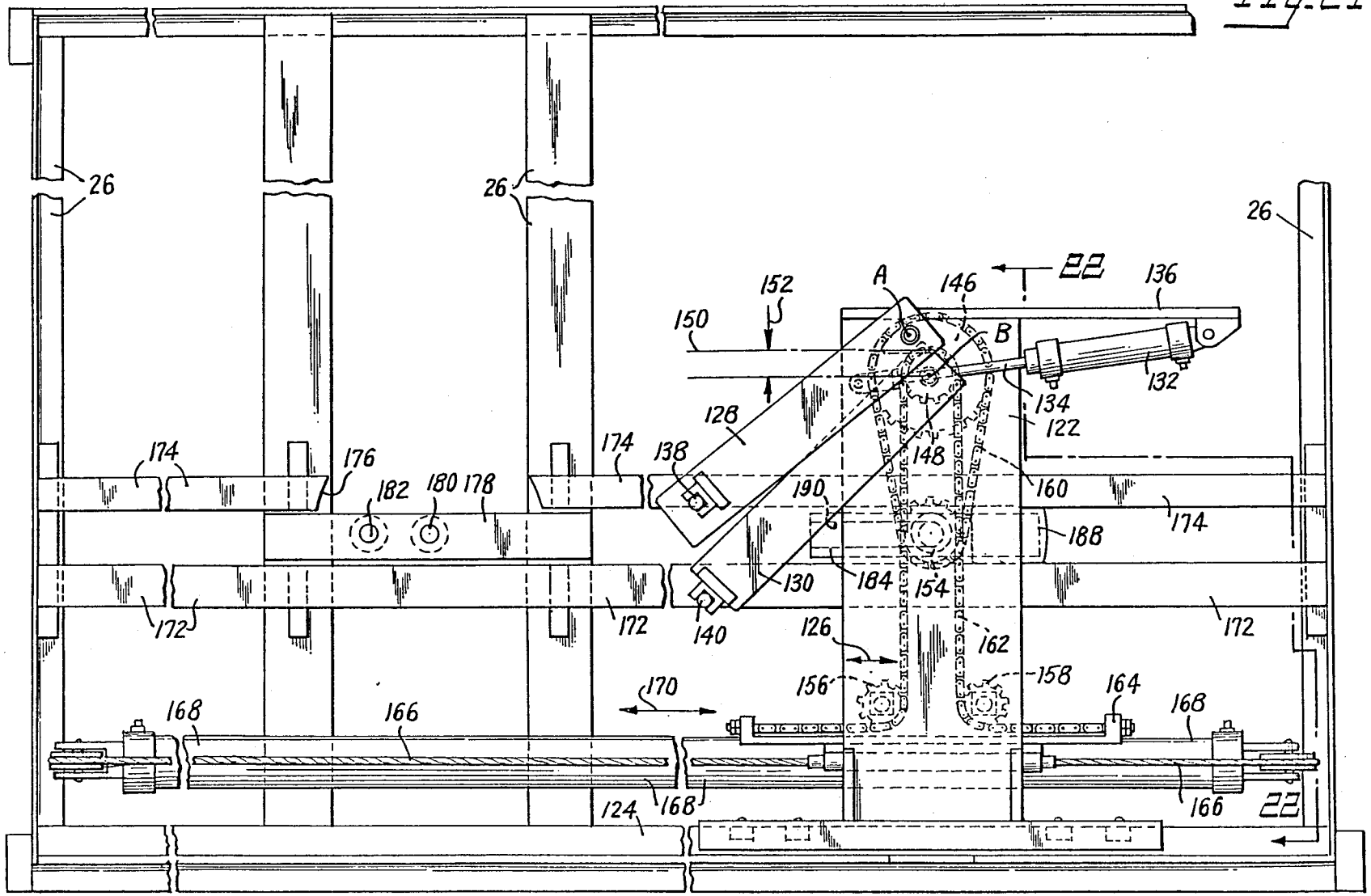
FIG. 21 is a partial, horizontal plan view showing the drive mechanism for the traversing carriage and the rotatable discs according to the invention.

The drive mechanism for the carriage 30, and the inner and outer discs 36 and 34, respectively, will now be described with reference to FIGS. 21–25. Figure 21 shows a top plan view of the table structure 26 with the sewing machine 24 and the carriage 30 removed for clarity. A lower carriage 122 is slidably supported on rail 124 which, in turn, is rigidly attached to the table structure 26. Lower carriage 122 is supported such that it may translate in the direction of arrows 126 in Figure 21. Carriage 30, along with rotating discs 34 and 36 are attached to lower carriage 122 so as to traverse in the directions of arrows of 126 with lower carriage 122.

As can be seen, lower carriage 122 is generally planar in construction and has control arms 128 and 130 rotatably attached thereto. Control arm 128 is pivotally attached to lower carriage 122 such that its axis of rotation coincides with axis A, shown in FIG. 5, the axis of rotation of inner circle 36. Similarly, control arm 130 is attached to lower carriage 122 such that its rotational axis coincides with axis B, the axis of rotation of outer disc 34. Control arm 128 is connected to control cylinder 132 ia an extendable and contractible piston rod 134. Control cylinder 132 is fixedly attached to lower carriage 122 by bracket 136. Control arm 128 is connected to the underside of inner disc 36 by an extendable and contractible pin 138 which, when in the extended position shown in FIG. 22, engages a corresponding opening formed on the lower surface of inner disc 36. Thus, the control arm 128 is in the position shown in FIG. 21 when the inner disc is in the position shown in FIGS. 5and 6. Retraction of the piston rod 134 causes the control arm 128 to pivot about axis A approximately 90° to the position shown in FIG. 25. This causes the rotation of the inner disc 36 to the position shown in FIG. 7.

Figure 22:
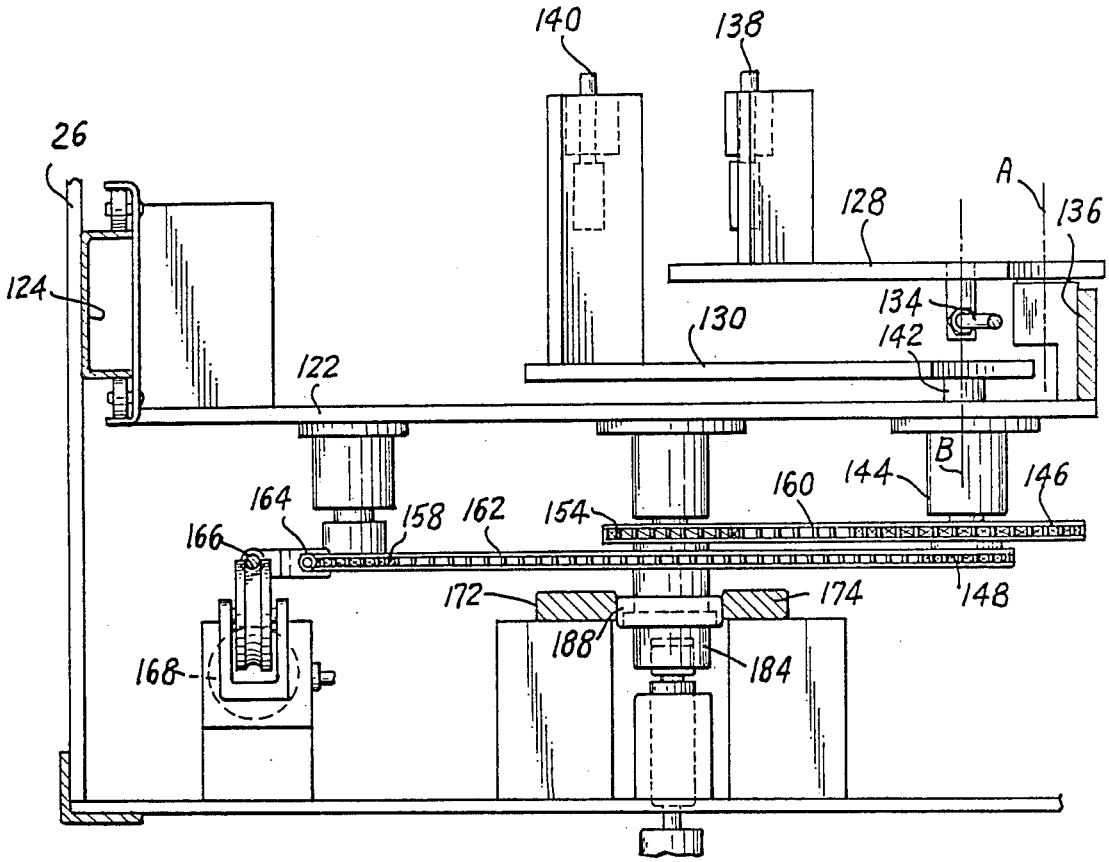
FIG. 22 is a fragmentary, vertical sectional view taken along line 22—22 in FIG. 21.

Control art 130 is interconnected with outer disc 34 via a pin 140 extending upwardly from the end of the control arm and engaging a corresponding opening formed in the bottom surface of outer disc 34. At the other end of control arm 130, shaft 142 is fixedly attached to the control arm and pivotally extends through hub 144 attached to lower carriage 122. A sprocket 146 is fixedly attached to the portion of shaft 142 extending beyond hub 144. Also mounted on this shaft is sprocket 148 which, as seen in FIG. 22, extends below sprocket 146. The pitch radius of sprocket 148 is equal to the sew radius of the curved portion **22*a* of "J" stitch 22. Hub 144 is mounted such that the pitch radius of sprocket 148 lies tangent to the center line of the sewing path designated at 150 in FIG. 21. The distance between the center of hub 144 and the center line of the sewing path 150 is known as the offset distance 152**.

Sprockets 154, 156 and 158 are also rotatably attached to the underside of lower carriage 122 as shown in FIGS. 21 and 22. The pitch diameter of sprocket 154 is one-half that of sprocket 146, these sprockets being interconnected by endless chain 160. Although the invention will be described by using chain drive elements, quite obviously other drive means can be substituted therefore without exceeding the scope of this invention.

Drive chain 162 passes partially around sprocket wheels 156 and 158 and also around sprocket wheel 148 as best shown in FIG. 21. The opposite ends of drive chain 162 are attached to the drive member 164. Drive member 164, in turn, is fixedly attached to ends of drive cable 166 which forms a part of a cable type actuating cylinder 168 rigidly attached to the table structure 26. Cable type actuating cylinder 168 is a known type device in which a piston travels within the cylinder, and which may be actuated by pneumatic or hydraulic pressure. Ends of cable 166 are attached to opposite sides of the piston Thus, as the piston travel within cylinder 168, the cable 166 and, consequently, the drive member 164 travels in the direction of arrows 170 in FIG. 21.

Guide rails 172 and 174 are fixedly attached to the table structure 26 and extend generally parallel to the direction of travel of carriage 122. As best seen in FIG. 21, guide rail 172 is continuous along the length of the table 26, however, guide rail 174 defines a gap 176.

Figure 23:
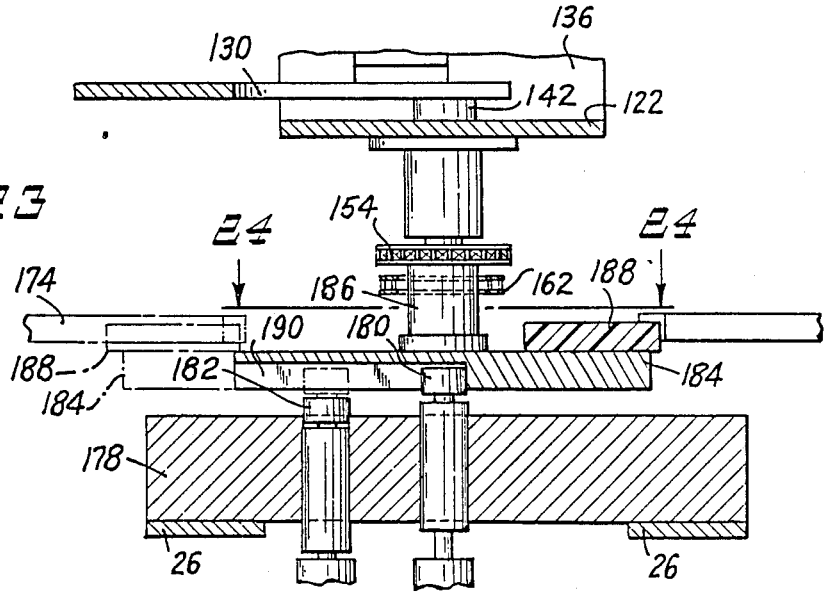
FIG. 23 is a fragmentary sectional view taken along line 23—23 of FIG. 24.

Support block 178 is mounted between the guide rails and below their plane, as seen in FIG. 23, and supports a pair of retractable pins 180 and 182. The pins 180 and 182 are movable between an extended position, as shown by pin 180 in Figure 23, and a retracted position, as illustrated by pin 182 in FIG. 23. The pins may e controlled by pneumatic cylinders or the like.

Guide member 184 is attached to sprocket 154 by hub 186 such that these elements rotate together. Guide member 184 has guide block 188 slidably attached to an upper surface such that the guide block 188 extends between guide rails 172 and 174. Guide member 184 also defines a longitudinal slot 190 which extends partially along the length of the member 184 and is sized so as to accommodate either of the retractable pins 180 or 182.

At the initiation of the sewing cycle, the drive elements are in the positions shown in FIG. 21 which corresponds to the positions of the carriage 30, and the inner and outer discs 34 and 36 shown in FIG. 5. Since carriage 30 is fixedly attached to lower carriage 122, its motion will correspond to that of the lower carriage. The carriages 122 and 30 are moved toward the left, as seen in FIGS. 5 and 21, by actuating the cable actuating cylinder 168 and causing the drive member 164 to move to the left as seen in FIG. 21. Drive chain 162 exerts a rotative force on sprocket 148 which, in turn, exerts rotative forces on sprocket wheel 146 and, through chain 160, sprocket 154. However, since sprocket 154 is fixedly connected to guide member 184 and guide block 188, the respective sprockets are prevented from turning due to the engagement of the guide block 188 between guide rails 172 and 174. Thus, motion of drive member 164 serves to translate the lower carriage and associated components to the left in the direction of arrow 126.

The movement of the apparatus to the left during the initial process of attaching the assembled fly to the jeans panel, illustrated in FIG. 15, is limited by the engagement of pin 182 with the end of slot 190 in guide member 184. In this instance, pin 180 is lowered and pin 182 is raised so as to allow the carriage 30 to traverse approximately $\frac{3}{8}$ of an inch beyond the bottom of the fly. The carriage assembly is moved to the right, approximately $\frac{3}{4}$ of an inch and stops while pin 182 is retracted and pin 180 is raised.

At this point, actuating cylinder 132 is activated to cause control arm 128 to rotate about axis A approximately 90° to thereby rotate the inner circle 36 to the position shown in FIG. 7.

Figure 24:
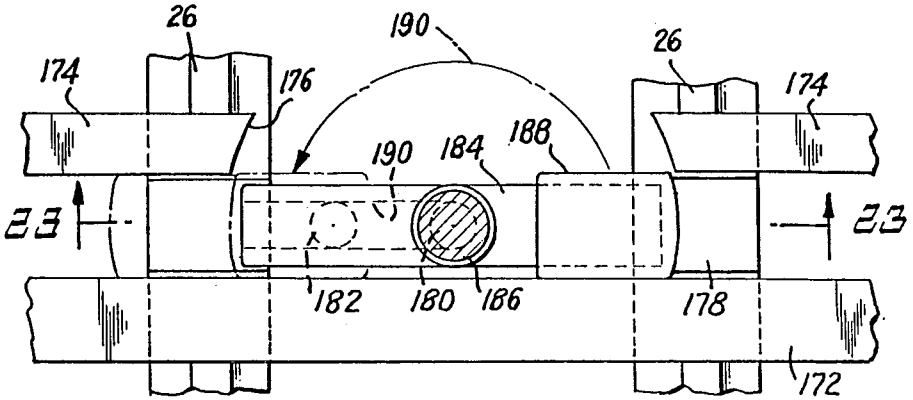
FIG. 24 is a fragmentary sectional view taken along line 24—24 in FIG. 23.
Figure 26:
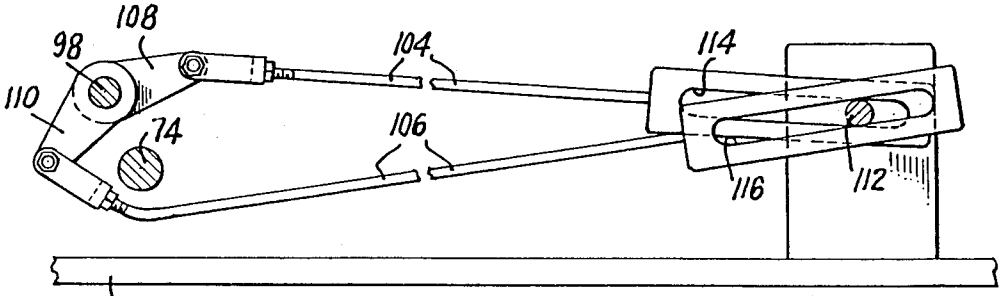
FIG. 26 is a fragmenting sectional view of the drag links taken along line 26—26 of FIG. 17.
Figure 25:
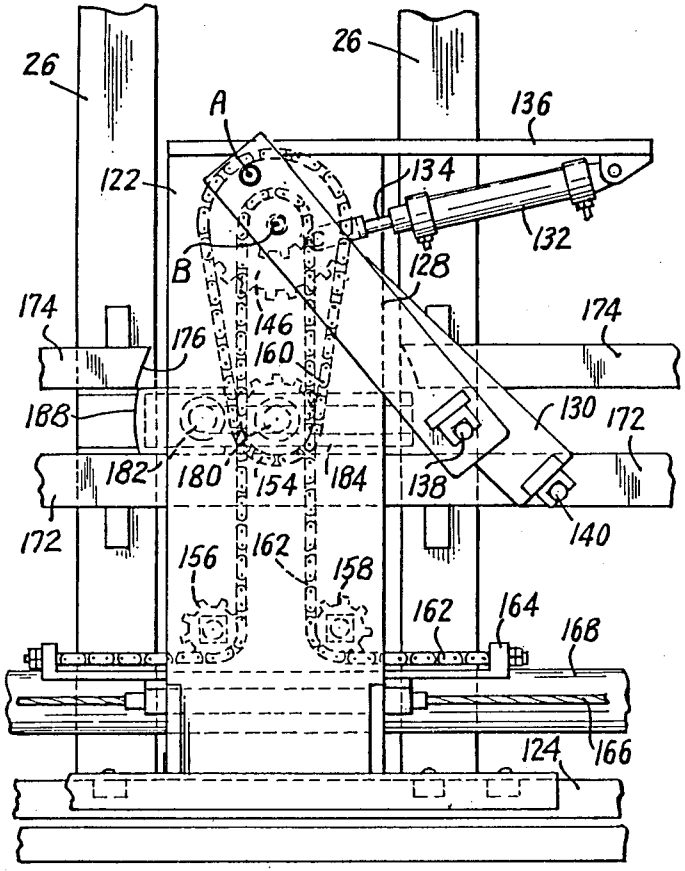
FIG. 25 is a fragmentary plan view similar to FIG. 21, but showing the actuating arms for the rotating discs in their rotated positions.

The carriages 122 and 30 are then once again moved to the left as viewed in FIGS. 21 and 7 for a distance of approximately four stitches after which pin 180 contacts the end of groove 190. This prevents any further traversing movement of the carriages 122 and 30 with respect to the sewing machine. However, when this takes place, guide bock 188 is within the gap 176 defined in guide rail 174 as shown in FIGS. 23 and 24. As the drive member 164 continues its movement to the left due to the forces exerted thereon by the actuating cylinder 168, it moves drive chain 162 relative to the carriage 122. Since the guide block 188 is no longer restrained between the guide rails, the chain 162 rotates sprockets 148 and 146, thereby imparting a rotation to sprocket 154 via drive chain 160. As sprocket 154 rotates, the guide block 188 travels along path 190, illustrated in FIG. 24 until it comes into contact with guide rail 172 after approximately 180° of motion. Since sprocket wheel 154 is one-half the diameter of sprocket wheel 146, the 180° of rotation of sprocket 154 causes 90° of rotation of sprocket wheel 146. This motion is imparted to control arm 130 via shaft 142 such that control arm 130 moves through an arc of approximately 90° to the position shown in FIG. 25. This serves to rotate the outer disc 34 during the sewing of the curved portion **22*a* of the "J" stitch 22**.

Once the guide member 184 and guide block 188 have rotated 180°, the carriages 122 and 30 can then continue their translational movement toward the left, as seen in FIG. 24, since pin 180 no longer bears against the end of slot 190. Since this slot is opened on one end, the carriage continues toward the left to finish the stem portion **22*b* of the "J" stitch 22**.

By reversing the cable actuating cylinder 168, the carriages traverse to the right, as seen in FIG. 21 and guide member 184 once again engages pin 180 to rotate 180° thereby returning the outer disc 34 to its original position. Actuating cylinder 132 is activated to return control arm 128 and inner disc 36 to their original positions shown in FIG. 21 and the apparatus is ready for another operational cycle.

The foregoing descriptions are provided for illustrative purposes only and should not be construed as in any way limiting this invention, the scope of which is defined solely by the appended claims.

What is claimed is:

1. A method for sewing a plurality of clothing components together comprising:

(a) placing a first clothing component onto a work table;

(b) placing a second clothing component in a clamping device;

(c) moving the clamping device such that a first portion of the second clothing component bears against the first clothing components;

(d) sewing a first stitch row to attach the components together;

(e) rotating the components through a first angle;

(f) sewing a second stitch row while rotating the components through a second angle such that at least a portion of the second stitch row is curved.

2. The method according to claim 1 comprising the additional step of reorienting the clamping device after sewing the first stitch row such that a second portion of the second component bears against the first component.

3. The method according to claim 2 wherein the first angle comprises approximately 90°.

4. The method according to claim 3 wherein the second angle comprises approximately 90°.

5. The method according to claim 4 wherein the first clothing component comprises a jeans panel.

6. The method according to claim 5 wherein the second clothing component comprises a fly assembly having a left fly portion, a right fly portion and a zipper tape interconnecting the left and right portion.

7. The method according to claim 6 comprising the additional step of folding a portion of the jeans panel prior to moving the clamping device such that the first portion of the fly assembly bears against the folded portion of the jeans panel.

8. The method according to claim 7 wherein the left fly portion of the fly assembly bears against the folded portion of the jeans panel.

9. The method according to claim 8 wherein the second stitch row is sewn in the general shape of a "J".

10. The method according to claim 1 wherein the step of moving the clamping device comprises rotating the clamping device through an arc about an axis.

11. The method according to claim 10 comprising the additional step of translating the clamping device in a direction generally perpendicular to the axis before sewing the first stitch row.

12. The method according to claim 11 comprising the additional step of rotating the clamping device through a second arc about the axis such that a second portion of the left fly bears against the jeans panel before sewing the second stitch row.

* * * * *